US006270430B1

(12) United States Patent
Nicoloff

(10) Patent No.: US 6,270,430 B1
(45) Date of Patent: Aug. 7, 2001

(54) SPORTS TRAINER

(76) Inventor: Thomas Paul Nicoloff, 868 Kowal Dr., Mississauga (CA), L5H 3T4

( * ) Notice: Subject to any disclaimer, the term of this patent is extended or adjusted under 35 U.S.C. 154(b) by 0 days.

(21) Appl. No.: 09/399,635

(22) Filed: Sep. 20, 1999

(51) Int. Cl.[7] ..... A63B 69/00

(52) U.S. Cl. ..... 473/458; 473/422; 473/461; 473/277; 473/207

(58) Field of Search ..... 473/206–208, 473/212–217, 227–229, 252–258, 266, 277, 458, 46; 2/16, 311–323; 273/DIG. 30; 70/14–16; 128/869, 878, 876; 434/247–252; 446/26, 28; 472/133; 482/121–125

(56) References Cited

U.S. PATENT DOCUMENTS

| | | | | |
|---|---|---|---|---|
| 2,103,502 | * | 12/1937 | Webster | 473/215 |
| 3,937,465 | * | 2/1976 | Roland | 473/461 |
| 4,399,994 | * | 8/1983 | Hourihan | 473/208 |
| 4,662,640 | * | 5/1987 | Grander | 473/215 |
| 4,889,336 | | 12/1989 | Schneiderman . | |
| 5,154,416 | * | 10/1992 | Smull et al. | 473/458 |
| 5,295,690 | | 3/1994 | Johnson . | |
| 5,443,266 | | 8/1995 | Bursi . | |
| 5,582,551 | | 12/1996 | Bursi . | |
| 5,688,184 | | 11/1997 | Johnson . | |
| 5,718,640 | | 2/1998 | Noblin . | |
| 5,893,803 | | 4/1999 | Leadbetter et al. . | |

* cited by examiner

*Primary Examiner*—Jeanette Chapman
*Assistant Examiner*—Mitra Aryanpour
(74) *Attorney, Agent, or Firm*—Ohlandt, Greeley, Riggiero, & Perle, L.L.P.

(57) ABSTRACT

A sports training device which consists of a body belt which can be secured around the body, an elastic cord and an implement holder. The elastic cord is attached to an adjustable length strap on the belt so that the end of the elastic cord can be drawn snug against the body or eased off. The elastic cord passes through a slide ring. The implement holder, which can be secured around a sports implement or stick, is attached at the free end of the elastic cord.

7 Claims, 3 Drawing Sheets

SPORTS TRAINER

FIELD OF THE INVENTION

The invention relates to a sports training device, and in particular, to a body belt incorporating a resilient extendable element, for training hitting strokes with a sports implement.

BACKGROUND OF THE INVENTION

The training of hitting strokes in stick sports requires the use of both hands. Normally, in a right-handed player, the right hand will push the stick forwards and the left hand will either control the stick or, in fact, pull the butt of the stick backwards.

This is particularly true in hockey where the hands are held far apart. It would also be true in other stick sports such as lacrosse. It is also useful in baseball and golf, and may be useful in other sports.

One of the problems in training persons to handle an implement such as a stick effectively is that the use of both hands is essentially an afterthought and is often ignored. One hand often simply does nothing more than steady the butt of the stick, without assisting in providing power to the hitting stroke.

It has been found that, in this form of power stroke, by using the left hand simultaneously with and coordinated with the right hand, greatly increased power and accuracy can be obtained as compared with using only one hand for the power and leaving the other hand more or less in a passive guiding function.

When using both hands the right (or lower) hand pushes the stick forward while the left (or upper) hand simultaneously pulls the butt backwards. The stick in effect pivots about a notional fulcrum located more or less between the hands. The invention is directed to providing a training device to speed up the learning of this process, effectively training the brain to do the right moves.

Even with sports where the implement is held only in one hand the invention will have application to train particular types of strokes

BRIEF SUMMARY OF THE INVENTION

With a view to providing a sports training device which is directed to the foregoing functions, the invention provides a training device which consists of a body belt adapted to be secured around the body, an extendable element attached to the belt, and an implement holder at the free end of the extendable element for securing a sports implement.

In another embodiment, the training device consists of a body belt which can be secured around the body, typically the waist and tightened up snugly, with adjustable buckles provided for the purpose. An elastic cord is attached to an adjustable length strap on the belt so that the fixed end of the elastic cord can be drawn snug against the body or eased off. The elastic cord passes through a slide, which typically is made of something such as a metal ring or plastic eye, and at the free end of the elastic cord there is attached an implement holder provided with some form of means whereby the holder can be secured around the implement or stick.

For hockey, the invention will enable the stick holder to be secured to the stick between the right and left hand positions on the stick. The use of an elastic cord permits the stick to be moved away from the body or drawn back again and allows a player to skate or run or move without obstruction from the elastic cord attached to the stick.

At the same time, the act of hitting will normally involve pushing the stick somewhat forwardly away from the body, and this will tension the elastic cord. This in turn will cause the muscles in both the right and the left arms to work simultaneously.

When a hitting stroke is made, the forward movement of the lower hand will naturally be complemented by a rearward pulling movement of the upper hand, thereby applying force from both hands to the stick, and achieving a stronger hitting stroke.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
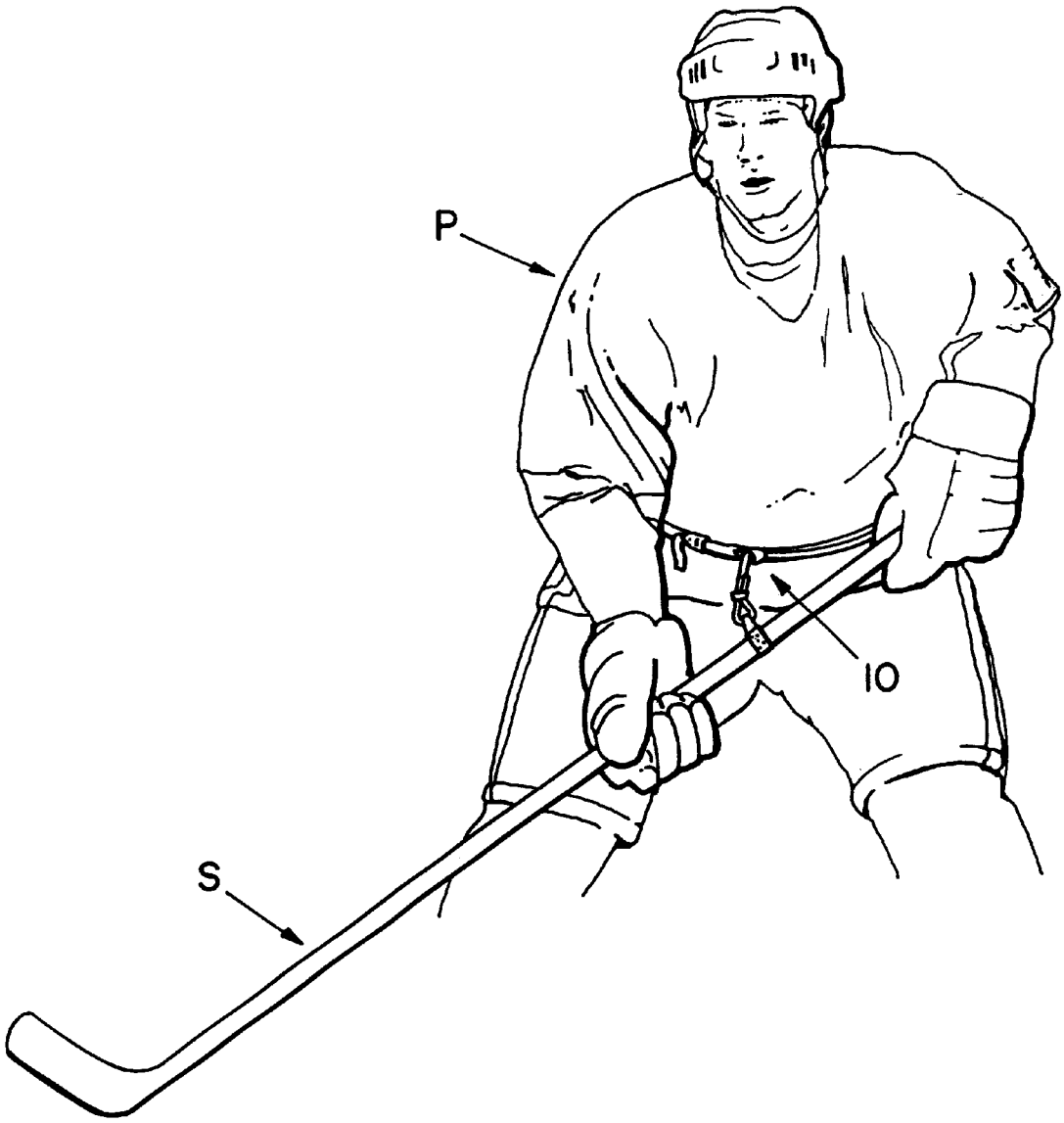
FIG. 1 is a front perspective illustration illustrating a sports player, in this case, a hockey player, carrying a hockey stick and showing the sports training device secured to his body and to his stick.
Figure 2:
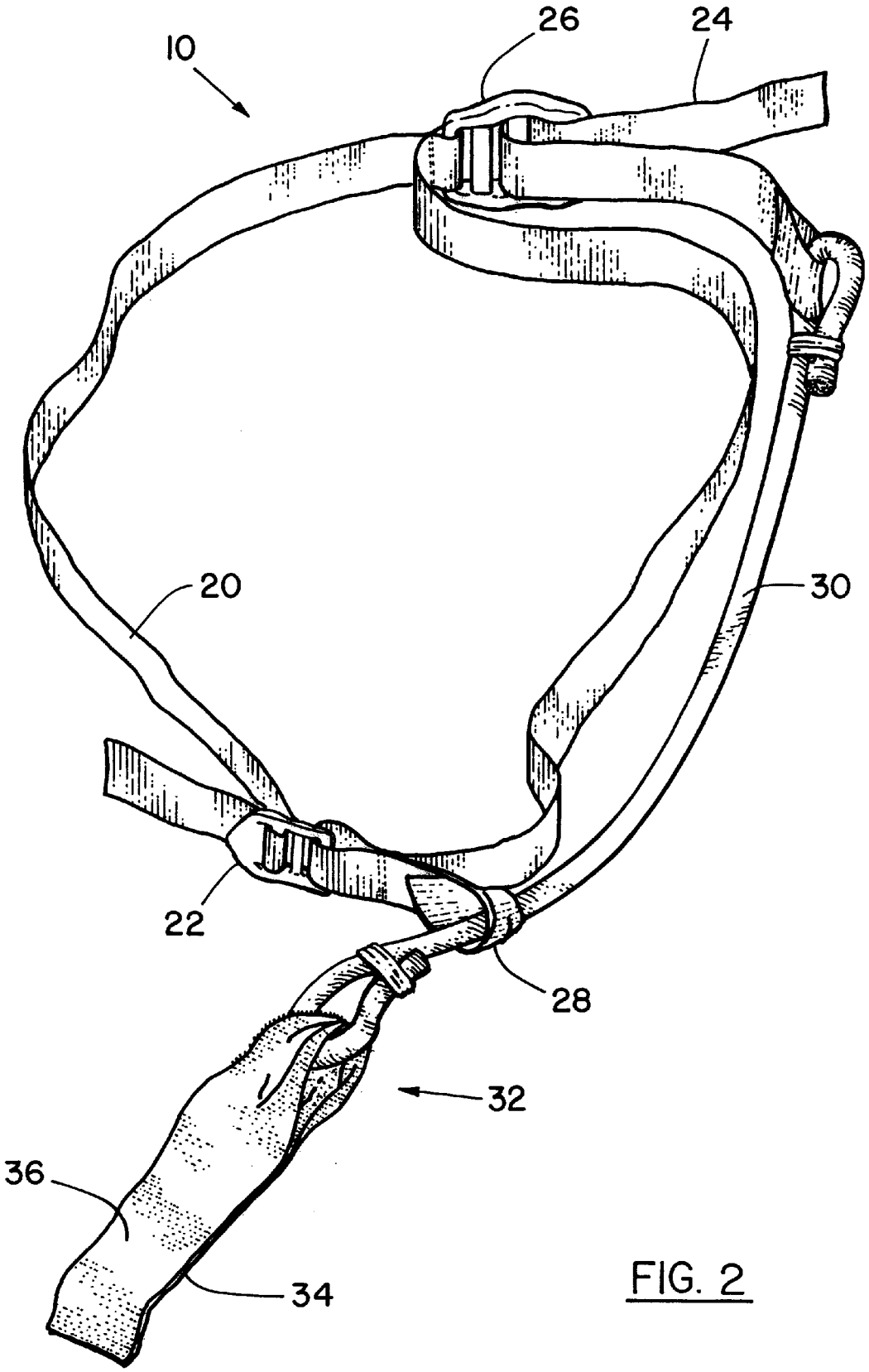
FIG. 2 is a perspective illustration showing the sports training device in isolation.

Referring first to FIGS. 1 and 2 it will be seen that the invention is illustrated in the form of a training device for training players in the game of hockey.

In hockey, the stick is held with both hands, with the hands being positioned apart from one another. Usually in a right handed player the left hand is at the butt end of the stick and the right hand is extended down the stick intermediate the butt end and the blade. There may be some players who hold the stick with the hands reversed, and of course left handed players will usually hold it the other way around. Although not strictly relevant, such hockey sticks are made with blades which are curved so that the concave side of the blade is usually facing the puck and is used for striking the puck, at least when making a power stroke.

It is found that experienced and more successful players develop their power strokes by using the force of both arms to swing the stick.

The lower hand, usually the right hand, is forced forwardly to swing the blade forwards, and the left hand simultaneously pulls the butt end rearwardly.

This has the effect of imparting more power to the blade and thus creating a harder more powerful stroke. It is also found that a stroke made in this way has more control and accuracy.

In less experienced, and younger players however, it is found that they will usually use the strength of only one hand and arm, for the most part, when making a stroke. Usually such players will swing the stick by simply pushing or extending the lower hand, usually the right hand, forwardly.

The upper or left hand usually is simply used to hold the butt end of the stick without actively applying force to it. Strokes made in this way are both less powerful and also less accurate than strokes using both hands effectively.

Training such players in the use of both hands and arms in a coordinated manner is slow and difficult and may not always succeed.

Similar problems exist in training the hands and arms of players in other sports. Baseball and golf are two sports where, in general, the training of the use of both hands and arms is desirable but is often not successful.

In other sports played with equipment, such as sticks, bats, racquets and the like, even where only one hand is used, there is also some benefit from the use of the invention.

The invention has therefore as a general objective the provision of a sports training device for training the use of the arms and hands in sports of various kinds.

As best shown in FIGS. 1 and 2 it will be seen that a player P is shown equipped for hockey and is carrying a stick S. The right hand is lower down the stick, and the left hand is at the butt end of the stick.

The invention is illustrated in the form of the training device indicated generally as 10. It comprises a body belt 20 with a buckle 22 which can be secured around the torso of the player P. In hockey, the belt 20 will be located around the waist. In other sports the belt might be secured around the chest, or in some other position. Possibly it may in some case be desirable to provide some sort of harness going over the shoulders in order to maintain the belt in position. In other cases there may be a strap passing down the back and between the legs, in order to hold the belt lower down. All of these factors will depend on the type of sport being trained, and the type of stroke being developed.

Attached to the belt 20 is a strap 24. Usually this strap will be formed of some non-extendable material. The strap is secured with an adjustable fastening, such as buckle 26 on one side of the belt 20. The strap 24 can be adjusted by simply readjusting it ;in the buckle 26.

A slide ring or loop 28 is attached to the belt 20 at a point located at the front of the player. The ring or loop 28 may be made of metal or plastic in most cases, although a loop of flexible material can also be used. It is preferable that the ring or loop 28 shall have minimum friction for reasons to be described.

A stretchable element 30 is attached to a free end of strap 24. The element 30 is made of some form of resilient elastic material so that it can be stretched and placed in tension by extending it away from the body.

The element 30 extends through the ring or loop 28 and extends to the front of the body, for hockey training at least. The precise location and other features of the element 30 will of course vary from one sport to another.

At the free end of the element 30 there is an attachment device 32. In this case as illustrated the device 32 comprises a fabric loop 34 typically of some kind of webbing material which can be wrapped around stick S. Device 32 is provided with some kind of fastening means 36. In this case a hook and pile fastening (Velcro, trade mark) is used, but other forms of fastening can be used in its place.

In this way the attachment device can be secured around the stick S at a point more or less midway between the two hands.

Figure 3:
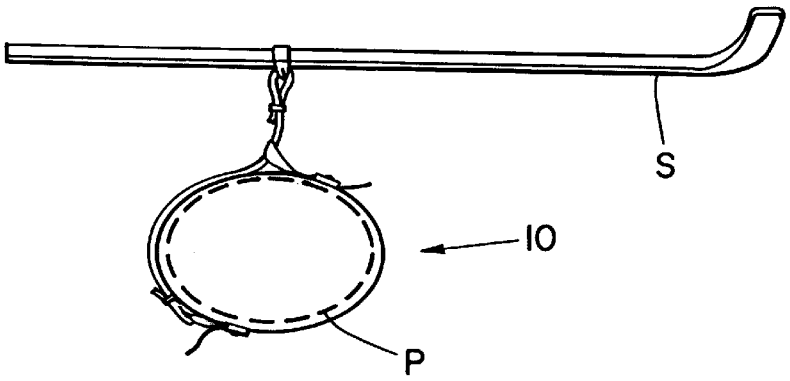
FIG. 3 is a top plan schematic view of the sports training device showing the elastic cord in its relaxed, contracted position, and showing the torso of a player in phantom.
Figure 4:
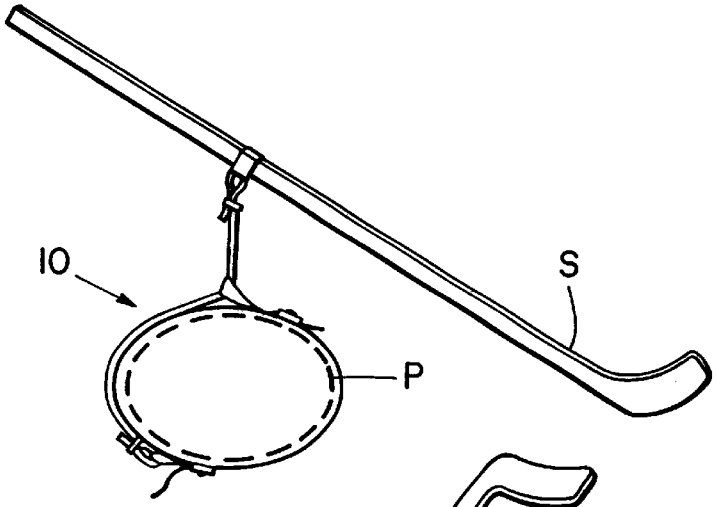
FIG. 4 is a top plan view corresponding to FIG. 3 showing the stick in a pre-shot extended position.

As shown in FIG. 1 and FIG. 3, the player P can still carry the stick S in the normal way, across the body, and can move the stick S while skating, by simply extending the hands away from the body (FIG. 4) and thus tensioning the element 30.

Figure 5:
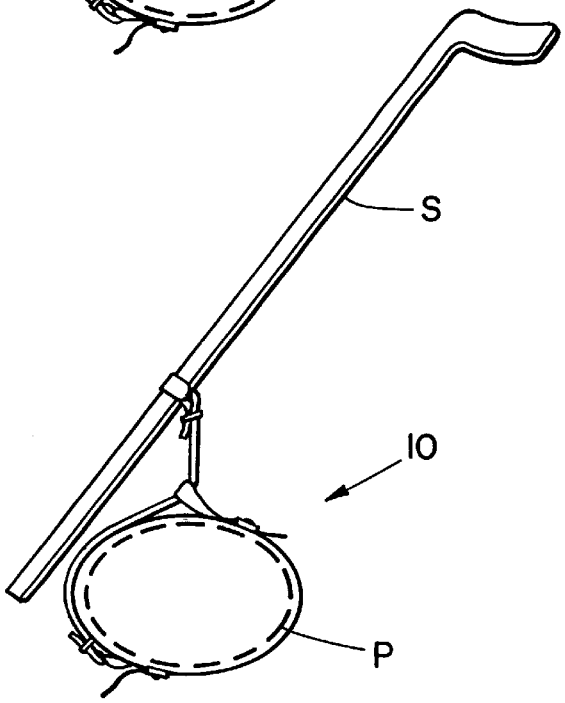
FIG. 5 is a top plan view corresponding to FIG. 3 showing the stick in a after-shot position.

When making a hitting stroke however it will be understood that the player P will usually move both hands forwardly away from his. body (FIG. 5). In doing this he will extend the element 30 further. Element 30 thus slides through the ring or loop 28 to permit this movement of the stick S away from the body. This will have the effect of placing the muscles in both arms of the player, under some degree of stress. The player P then makes his shot by swinging the lower (right) hand forwardly. The upper (left) hand will naturally swing rearwardly, with the element 30 and attachment device 32 acting as a kind of fulcrum.

In this way the player P quickly learns to coordinate the action and movement of both hands when using the stick S to make a shot.

After even quite a brief period of training, depending upon the aptitude of the player P, the training device 10 can be detached and the player will find that the coordinated use of both hands becomes a natural action for him.

It is believed that one principal advantage of the invention is that because the natural tendency is to reach forward with both hands, the element 30 will be placed in tension. This will have the effect of placing the muscles in both arms under stress in order to stretch the element 30. This will then enable the player P to get a feel for the use of both hands, since both arms will already be tensed up in order to stretch the element 30.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A sports training device for training in the use of sports implements particularly for training the coordinating of the use of the hands and muscles, which comprises:

a body belt adapted to be secured around the body;

an adjustable length non-elastic strap having a first end and a second end, and being connected to said body belt at the first end of said strap;

an elastic stretchable element being connected to the second end of said strap, said strap being adjustable so that the elastic stretchable element can be drawn snug against or eased off the body;

a slide loop on the belt through which said elastic stretchable element passes; and an implement holder at the free end of said elastic stretchable element for securing a sports implement.

2. A sports training device as claimed in claim 1, wherein the sports implement is held with the right and left hands separated from each other, and wherein the implement holder is secured to the sports implement between the right and left hand positions.

3. A sports training device as claimed in claim 1, wherein the implement holder is secured at an end of the sports implement.

4. A sports training device as claimed in claim 1, wherein the elastic stretchable element is an elastic cord which permits the sports implement to be moved away from the body or drawn back again and allows a player to otherwise move without obstruction from the training device.

5. A sports training device as claimed in claim 1, wherein the elastic stretchable element has tension that increases as the elastic stretchable element is stretched and increased in length, as a consequence of the sports implement being moved away from the body during the act of operating the sports implement.

6. A sports training device as claimed in claim 5, wherein a forward movement of one hand will naturally be complemented by a rearward pulling movement of the other hand, thereby applying force from both hands to the sports implement.

7. A sports training device as claimed in claim 1, the holder comprising a web material with a hook and pile fastening mechanism.

* * * * *